United States Patent [19]

Honjo et al.

[11] 3,982,938

[45] Sept. 28, 1976

[54] PHOTOCONDUCTIVE TONERS WHICH INCLUDE PHOTOCONDUCTIVE PIGMENT PARTICLES IN A CHARGE-TRANSPORTING INSULATING BINDER

[75] Inventors: Satoru Honjo; Hajime Miyatuka; Seiji Matsumoto, all of Asaka, Japan

[73] Assignee: Fuji Photo Film Co., Ltd., Minami-ashigara, Japan

[22] Filed: Feb. 12, 1974

[21] Appl. No.: 441,861

[30] Foreign Application Priority Data

Feb. 13, 1973 Japan ..... 48-17715

[52] U.S. Cl. ..... 96/1.5; 96/1.6; 252/62.1 P; 252/501

[51] Int. Cl.[2] ..... G03G 5/04

[58] Field of Search ..... 96/1.5, 1.6; 252/62.1 P, 501

[56] References Cited

UNITED STATES PATENTS

| | | | |
|---|---|---|---|
| 2,986,521 | 5/1961 | Wielicki | 252/62.1 P |
| 3,060,020 | 10/1962 | Greig | 252/62.1 P |
| 3,140,175 | 7/1964 | Kaprelian | 96/1.5 |
| 3,143,508 | 8/1964 | Kaprelian | 252/62.1 P |
| 3,764,315 | 10/1973 | Mort et al. | 96/1.5 |
| 3,775,103 | 11/1973 | Sadamatsu et al. | 96/1.5 |
| 3,820,984 | 6/1974 | Gundlach | 96/1.5 |
| 3,825,421 | 7/1974 | Tamai | 96/1.5 |

FOREIGN PATENTS OR APPLICATIONS

| | | | |
|---|---|---|---|
| 1,165,017 | 9/1969 | United Kingdom | 252/62.1 P |

*Primary Examiner*—David Klein
*Assistant Examiner*—Judson R. Hightower
*Attorney, Agent, or Firm*—Gerald J. Ferguson, Jr.; Joseph J. Baker

[57] ABSTRACT

Improved toner particles each comprising an intimate mixture of a photoconductive pigment and an insulating binder capable of transporting charge carriers when the charge carriers are injected therein from the pigment, the proportion of the total volume of the pigment in the toner particle being 2 to 30 volume percent of the toner particle and the insulating binder being substantially transparent to the light in the region of the spectrum to which the pigment is sensitive. The toner particle may have therein a core or cores of a material which is substantially transparent to the light in the spectral-sensitive region of the pigment. The toner particles have improved surface durability and can be used repeatedly.

14 Claims, 3 Drawing Figures

PHOTOCONDUCTIVE TONERS WHICH INCLUDE PHOTOCONDUCTIVE PIGMENT PARTICLES IN A CHARGE-TRANSPORTING INSULATING BINDER

BACKGROUND OF THE INVENTION

1. Field of the Invention

The present invention relates to novel photoconductive toner particles and, more particularly, it relates to novel photoconductive toner particles comprising a photoconductive pigment and an insulating binder.

2. Description of the Prior Art

A method of recording images utilizing photoconductive particles is known. In such a known method, a charged uniform layer of photoconductive particles formed on a conductive support is exposed with an optical image to dissipate the charge at the exposed areas and then only the toner particles which have a reduced electrostatic attractive force to the support are removed from the support using air, mechanical vibration, etc.

In such a system, the photoconductive layer comprises photoconductive toner particles and hence only the contact points of the toner particles contribute to the flow of the photoelectric current in the photoconductive layer. Therefore, in such a system light must penetrate sufficiently into the interior of the toner particle layer so that the resistance of the contact points of the toner particles is reduced sufficiently. This is quite important since the thickness of the toner particle layer must be about 90 g/m$^2$ from a practical standpoint (corresponding to a thickness of about 40 microns when no spaces are present between the toner particles).

A typical embodiment of the structure of a photoconductive toner meeting the above requirement is composed of a transparent core material having coated thereon a thin photoconductive layer as disclosed in Japanese Pat. No. 12,385/'69. However, the structure of each a photoconductive toner is inconsistent with the desirability of being able to use the photoconductive toner particles repeatedly in practical use.

First, the photoconductive surface of the toner tends to stain and separate from the core. This tendency is particularly remarkable when the surface layer of toner is composed of a mixture of photoconductive zinc oxide and a resin because such a surface layer has poor mechanical strength.

Another difficulty encountering in using the aforesaid toner particles is that the facility of handling the photoconductive toner particles changes during use. That is to say, the photoconductive particles tend to be electrostatically charged during handling due to their insulating property. In using photoconductive toner particles having a structure composed of a core and a photoconductive surface layer, when the surface layers are stripped during use, the triboelectric characteristics of the toner particles changes, which results in the toner particles aggregating readily. Of course, such a difficulty may be overcome by selecting the materials for the core and the surface layer so that each has the same triboelectric characteristics but this gives rise to new or additional difficulties or restrictions in the freedom for selection and combination of the materials forming the photoconductive toner.

Still another disadvantage is concerned with the properties of the photoconductive toner used in the method as disclosed in U.S. patent application Ser. No. 267,754, filed June 30, 1972, now abandoned. In this method a charged toner image is first formed on a conductive support, electrostatic coating is conducted on the image-carrying surface of the support using a powder paint having the same charge as the toner while the toner image retains the charge to prevent the adhesion of the powder paint to the toner image portions due to electrostatic repulsion, and after exposing the entire surface of the support to light, only the photoconductive toner particles are recovered from the support. In this method the toner particles recovered contain the powder paint and hence it becomes important to separate effectively the two components from each other. This problem can be readily solved if it is possible to use a combination of a powder paint and a photoconductive toner where the photoconductive toner has a specific gravity sufficiently smaller than that of the powder paint and where the photoconductive toner can retain a higher potential. More specifically, if the toner particles can retain a higher potential, strong repulsion can be secured on coating the powder paint and if the specific gravity of the toner is small, recovering the photoconductive toner particles only will be facilitated.

On the other hand, the toners disclosed in British Pat. No. 1,165,017 and Japanese Pat. No. 12,385/'68 do not have a small specific gravity. In fact, the specific gravity of the powder paint used in such system is generally about 2, and even if a thinner photoconductive layer is employed for the photoconductive toners using the technique of British Pat. No. 1,165,017 and Japanese Pat. No. 12,385/'68, the specific gravity of the photoconductive toners is about 1.8 to 2.2 in many cases.

Therefore, a further reduction in the specific gravity of the photoconductive toner has been desired.

In general, the photoconductive toner particles prepared by pulverizing a composition for an electrophotographic material showing good characteristics when the composition is used as a continuous photoconductive layer do not give satisfactory characteristics since light does not penetrate sufficiently into the interior of the photoconductive toner layer when such a material is used. Furthermore, since a photoconductive toner itself fulfills the function of forming an image, the photoconductive toner must have a definite density or light-scattering property, which is inconsistent with the aforesaid requirement of light penetrating sufficiently into the interior of the photoconductive toner layer. On considering these points, the above-described material does not result in a practically useful photoconductive toner.

Furthermore, a photoconductive toner composed of a transparent photoconductive material containing therein a sensitizer or a sensitizing dye is deficient in optical density as an image-forming material. When such a transparent colored toner is used for forming an image on an opaque white support, an image having good contrast is obtained but when a dark colored or black support such as a steel or iron plate and a black paper is used, the image of such a transparent toner formed on such a support becomes undiscernible.

On considering the aforesaid points it can be understood that the characteristics of the photoconductive toner particles are considerably different from the characteristics of conventional toner particles used for forming images on a photoconductive sensitive layer.

SUMMARY OF THE INVENTION

An object of this invention is, therefore, to provide a photoconductive toner having a novel structure.

Another object of this invention is to provide novel photoconductive toner particles having improved mechanical strength and capable of being used repeatedly without any degradation in the properties thereof.

Still another object of this invention is to provide novel photoconductive toner particles capable of forming toner images having good contrast even on a dark colored or black support.

A further object of this invention is to provide a recording method or an image-forming paint-coating method using such photoconductive toner particles.

The above-described objects of this invention are attained by the photoconductive toner particles of this invention.

The present invention provides photoconductive toner particles each comprising an intimate mixture of a photoconductive pigment and an insulating binder capable of transporting charge carriers when the charge carriers are injected therein from the pigment, the total volume of the pigment in the toner being 2 to 30 volume percent of the volume of the toner and the insulating binder being substantially transparent to light in the spectral region to which the pigment is sensitive.

Another embodiment of this invention provides photoconductive toner particles each comprising an intimate mixture of a photoconductive pigment and an insulating binder capable of transporting charge carriers when the charge carriers are injected therein from the pigment, the volume of the pigment in the toner being 2 to 43 volume parts per 100 volume parts of the binder and the binder being composed of a surface layer substantially transparent to light in the spectral region to which the pigment is sensitive and a core substantially transparent to at least the light in the spectral region to which the pigment is sensitive.

BRIEF DESCRIPTION OF THE ACCOMPANYING DRAWINGS

DETAILED DESCRIPTION OF THE INVENTION

As described above, the photoconductive toner of this invention has such a structure that at least the surface portion of the toner is composed of an intimate or substantially uniform mixture of a photoconductive pigment and an insulating binder which can transport charge carriers when the charge carriers are injected therein from the pigment, with the insulating binder being substantially transparent to the light in the spectral region to which the pigment is sensitive, (i.e., the spectrally-sensitive region) from the standpoint of the photoconductivity and the proportion of the pigment in the entire toner being 2 to 30, preferably 5 to 20, volume percent of the toner.

The photoconductive toner particles of this invention have the following advantages.

Because the proportion of the photoconductive pigment in the toner is low, the mechanical durability of the toner surface is high and hence when the toner particles are used repeatedly the surfaces of the toner particles are degraded or changed less.

Because the photoconductive toner of this invention is composed of a large proportion of the insulating binder or resin capable of transmitting the light in the spectrally sensitive-region of the photoconductive pigment in the toner, the active light can penetrate sufficiently into the interior of the layer of such photoconductive toner particles and thus the potential decay occurs very quickly when the charged toner particle layer is exposed to light. In this respect, the following point is of interest. That is to say, when the photoconductive pigment has absorption and spectral sensitivity in, e.g., a near ultraviolet region and a visible region and also the insulating binder has strong absorption in the near ultraviolet region, good results are obtained only when light capable of being transmitting by the binder is employed for the electrophotographic processing.

Accordingly, the term "substantially transparent to light in the spectrally-sensitive region of the pigment" has the above-described meaning, that is, with respect to the light employed, a binder having an absorption region which is outside of the absorption region of the photoconductive pigment is used in regard to the light employed. More specifically speaking, a binder having an absorption coefficient lower than $1.3 \times 10^2 mm^{-1}$ to the light to which the binder and the photoconductive pigment have a similar absorption region can be used.

If the photoconductive pigment is a n-type material, a binder capable of transporting electrons is used and if the photoconductive pigment is a p-type material, a binder capable transporting potitive holes is used. Of course, a mixture of a n-type binder and a p-type binder capable of transporting the both charge carriers of electrons and positive holes can be used.

Figure 1:
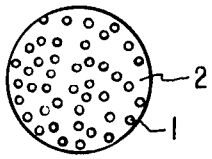
FIG. 1 is a schematic enlarged sectional view of an embodiment of the photoconductive toner of this invention.
Figure 2:
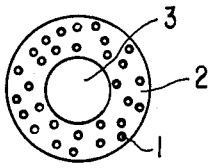
FIG. 2 is a schematic enlarged sectional view of another embodiment of the photoconductive toner of this invention.
Figure 3:
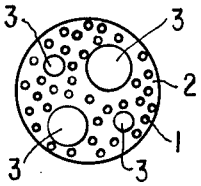
FIG. 3 is a schematic enlarged sectional view of still another embodiment of the photoconductive toner of this invention.

Then, the invention will now be explained in greater detail by referring to the accompanying drawings. The toner illustrated in FIG. 1 is composed of an intimate or uniform mixture of a photoconductive pigment 1 and an insulating binder 2. The toner illustrated in FIG. 2 is another embodiment of the photoconductive toner of this invention and has a structure in which the surface of a transparent core 3 is coated with an intimate or uniform mixture of a photoconductive pigment 1 and an insulating binder 2. The toner illustrated in FIG. 3 is also an embodiment of the photoconductive toner of this invention having a similar structure to the toner shown in FIG. 2, in which, however, a plurality of transparent cores 3 are present.

As the photoconductive pigment which can be used in this invention, such inorganic photoconductive materials as are described in the specification of U.S. Pat. No. 3,121,006 are suitable. Typical examples of inorganic photoconductive materials are zinc oxide, zinc oxide or titanium dioxide each having an expanded spectral-sensitive region due to the use of a sensitizer such as a sensitizing dye, cadmium sulfide, cadmium selenium sulfide, cadmium zinc sulfide, strontium calcium sulfide, zinc sulfide, magnesium zinc oxide, zinc selenide, selenium telluride, and a selenium-tellurium alloy. In particular, zinc oxide and titanium dioxide are preferable due to their lack of toxicity.

Also, as the photoconductive pigment, in this invention such organic photoconductive materials as are disclosed in the specifications of U.S. Pat. Nos. 3,357,989; 3,667,944; 3,463,819; and 3,464,819 can be employed. Specific examples of such organic photoconductive materials are X-form metal-free phthalocyanine, various other phthalocyanines, quinacridone pigments, solvent-insoluble vinylanthracene derivatives, etc. Of these materials, dye-sensitized vinylanthracene derivatives can be effectively used.

As the insulating binder used in this invention, various kinds of resins sensitized by a Lewis acid are suitable and examples of such resins are an epoxy resin, a phenoxy resin, a phenol-formaldehyde resin, polycarbonate, polystyrene, polysulfone, polyphenylene oxide, polyethylene terephthalate, a mixture thereof or a copolymer thereof.

Also, examples of Lewis acids which can be used for sensitizing the above-described resins are 2,4,7-trinitro-9-fluorenone, 2,4,5,7-tetranitro-9-fluorenone, picric acid, 1,3,5-trinitrobenzene, chloranil, 4,4-bis(dimethylamino)benzophenone, tetrachlorophthalic anhydride, benzanthracene, benzanthracene-7,12-dione, tetracyanobenzoquinodimethane, tetracyanoethylene, etc., and a mixture thereof.

The Lewis acid is usually added to the resin as the insulating binder in an amount of about 5 to 20 weight percent but, sometimes, in an amount of about 50 to 100 weight percent, e.g., where the absorption peaks of the photoconductor and the Lewis acid do not overlap.

Suitable sensitizing dyes used for sensitizing the pigments in this invention are xanthene dyes, phthalein dyes, triphenylmethane dyes, anthraquinone dyes, azo dyes, cyanine dyes, merocyanine dyes, etc.

As the xanthene dyes, C.I. Acid Yellow 73 (C.I. No. 45350), C.I. Acid Red 51 (C.I. No. 45430), C.I. Acid Red 52 (C.I. No. 45100), C.I. Acid Red 87 (C.I. No. 45380), C.I. Acid Red 94 (C.I. No. 45440), etc. can be used.

As the phthalein dyes, Rose Bengal, Bromo Chloro Phenol Blue, Bromo Phenol Blue, Chloro Phenol Blue, Phenol Red, Cresol Purple, etc. can be used.

As the triphenylmethane dyes, C.I. Acid Blue 9 (C.I. No. 42090), C.I. Acid Blue 15 (C.I. No. 42645), C.I. Acid Blue 22 (C.I. No. 42755), C.I. Acid Blue 90 (C.I. No. 42655), etc. can be used.

As the anthraquinone dyes, C.I. Acid Blue 23 (C.I. No. 61125), C.I. Acid Blue 27 (C.I. No. 61530), etc. can be used.

As the azo dyes, C.I. Acid Red 26 (C.I. No. 16150), C.I. Acid Red 27 (C.I. No. 16185), etc. can be used.

As the cyanine dyes and merocyanine dyes, those having a —COONa, —COOK, —$SO_3Na$, —$SO_3K$, etc. group as a substituent can be used.

These sensitizing dyes can be employed in an amount of from about 0.0005 to 2.0 parts by weight, preferably from 0.001 to 1.0 part by weight, per 100 parts by weight of the photoconductive substance.

Also, a charge carrier-transport type insulating binder can be prepared by dissolving an organic photoconductive material in a resin. Typical examples of such organic photoconductive materials are triphenylamine, 2,4-bis(4,4′-diethylaminophenyl)-1,3,4-oxadiazole, 2,5-bis(p-aminophenyl)-1,3,4-oxadiazole, triphenylpyrone, 4,5-diphenylimidazolidinone, 2-mercaptobenzothiazole, 2-phenyl-4-α-naphthylidene-oxazolone, 3-aminocarbazole, etc.

Furthermore, an organic photoconductive polymer alone can be used as the binder and if desired, a sensitizer such as a sensitizing dye or Lewis acid as described above can be added to the polymer. Examples of such an organic photoconductive polymer are poly-N-vinylcarbazole, halogen-substituted poly-N-vinylcarbazole, nitro-substituted poly-N-vinylcarbazole, polyacenaphthene, polyvinyl pyrazoline, polyvinyl anthracene, polyvinyl dibenzofuran, etc.

Generally many patents and literature reports on organic photoconductive compounds and binders are known and these described organic photoconductive compounds can be employed in this invention if the compounds have no strong absorption in the entire visible region. Selection can be easily made of the toner components by one skilled in the art based on the above description.

It is necessary that the photoconductive toner particles used in this invention provide a toner image having an optical contrast with the non-image portions. Also, the photoconductive dispersion consisting of a photoconductive pigment or compound and a binder almost transparent to visible light must have a light-scattering property (white color) or to be deeply colored.

In forming images on a dark colored support such as a steel plate or a primer-coated steel plate, the use of a toner which is transparent and scatters light is desirable, while in forming images on a light-color or a white support, the use of a colored toner is desirable. If the photoconductive toner as described in the specification of our previous patent application, U.S. patent application Ser. No. 267,757, filed June 30, 1972, now abandoned, acts an intermediate role yet does not form the final image, the above-described characteristic is unnecessary but it is necessary that the toner image exhibits an optical contrast to the powder paint during the step. In such case, a transparent photoconductive toner can be used if the powder paint has light-scattering properties.

The content of the photoconductive material or the photoconductive pigment in the binder generally is about 2 to 30 weight percent, preferably 5 to 25 weight percent. Toward the lower end of this range of the content of the photoconductive material is suitable for a comparatively fine photoconductive dispersion. It is also generally preferable that the particle size of the photoconductive toner particles be 2 to 200 microns. Toner particles having a size less than 2 microns are difficult to produce and, on the other hand, toner particles having a size larger than 200 microns do not exhibit sufficient photosensitivity. Within the aforesaid range, a particularly preferably range is 10 to 70 microns.

When the photoconductive toner of this invention is composed of a surface layer and a core material, it is necessary that the core material be also sufficiently transparent to the active light, i.e., the light to which the photoconductive material is sensitive. It is desirable from the standoint of cost and specific gravity to employ a hollow core material and in this case, the photoconductive toner can contain a single core or a plurality of cores. Suitably the core materials range in diameter from about 1 to 150 microns. It is preferred that the diameter of the core be about 10 to 40 microns. Suitable core materials transparent to the active light for the photoconductive layer are plastics, glass, pottery, porcelain, and a hydrocarbon vapor such as butene, propane, etc.

When the charge carrier transporting phase can transport positive holes, a photoconductive material capable of injecting positive holes is used, while when the charge carrier transporting phase can transport electrons, a photoconductive material capable of injecting electrons can be used. In another case, i.e., where the charge carrier transporting phase can transport both positive holes and electrons, a photoconductive material (a mixture of a n-type photoconductive material and a p-type photoconductive material) capable of generating both charge carriers due to the action of light and injecting both charge carriers can be used. Where both types of photoconductive materials are used, there is the advantage that good electrophotographic characteristics are obtained whether the photoconductive toner particle layer is charged positively or negatively.

Suitable processes to which this invention is applicable are disclosed in U.S. Pat. Nos. 3,418,972; and 3,451,376 and "Supplement on Electrophotography" *Applied Optics*, pages 124 to 129 (1969).

The invention will further be explained by reference to the following examples but the invention is not intended to be construed so being limited to these examples.

In addition, all parts, percents, ratios and the like in the following examples are by weight, unless otherwise indicated.

EXAMPLE 1

100 Parts of polyvinylcarbazole was dissolved in 560 parts of a mixture of cyclohexane and toluene (4:6 by volume) and after adding thereto 3 parts of cadmium selenium sulfide, 10 parts of zinc oxide having adsorbed thereon 4/1,000 part of Blue Dye No. 1, and 2 parts of X-form metal-free phthalocyanine, the mixture was kneaded to form a uniform dispersion. Then, 10 parts of 2,4,7-trinitrofluorenone was further added to the dispersion. From the mixture thus prepared, photoconductive toner particles comprising substantially spherical particles of about 30 to 45 microns in particle size were formed using a spray drying method.

After sufficient drying, the toner particles were subjected to dark adaption, spread over the surface of a paper subjected to a treatment to render the paper conductive (a bond paper coated with colloidal alumina) in a thickness of 80 g/m$^2$, and the photoconductive toner particle layer thus formed was charged positively (about 400 volts) and negatively (about −400 volts) using corona discharging.

Then, the photoconductive toner particle layer thus charged was exposed to a positive image and then air was blown onto the layer, whereby the photoconductive toner particles were removed at the areas corresponding to the negative portion to provide a toner particle image having high contrast.

The photoconductive toner particles thus removed were recovered and reused as a mixture thereof with fresh photoconductive toner particles for forming images in the same manner as described above, whereby an image having high contrast was also obtained.

The particularly remarkable phenomenon in the repeated use of the toner particles was that when the photoconductive toner particles thus recovered were used repeatedly together with fresh photoconductive toner particles, aggregation of the toner particles hardly occurred and further after 10 repeated uses, on reduction in image quality was observed.

EXAMPLE 2

10 Parts of cadmium selenium sulfide, 55 parts of polyethylene terephthalate, and 45 parts of 2,4,7-trinitrofluorenone were dissolved or dispersed in 250 parts of a mixture of methyl cellosolve and toluene (1:1 by volume) and from the mixture photoconductive toner particles comprising spherical particles of a diameter of about 50 microns were obtained by spray drying.

The photoconductive toner particles provided good images having high contrast in the manner as described in Example 1. Also, the photoconductive toner particles of this example have better images when charged positively than when charged negatively.

EXAMPLE 3

A dispersion of 5 parts of X-form metal-free phthalocyanine, 10 parts of zinc oxide having adsorbed thereon 3/1,000 part of Erythrosine, 100 parts of a (70:30 weight ratio; mol. wt. about 12,000) vinylcarbazole-ethyl acrylate copolymer, and 15 parts of 2,4,7-trinitrofluorenone in 300 parts of a mixture of benzene and methylene chloride (1:1 by volume) was mixed well in a ball mill. Then, from the dispersion, spherical photoconductive toner particles of a diameter of about 30 to 50 microns were formed by spray drying.

When an image was formed using the photoconductive toner particles in the same manner as in Example 1, good photoconductive characteristics were obtained in both of the cases of being charged positively and negatively.

EXAMPLE 4

100 Parts of glass balls having a diameter of 10 microns were added to 400 parts of a mixture having the same composition as in Example 3 followed by mixing to provide a uniform dispersion and then the dispersion was subjected to spray drying, whereby photoconductive toner particles of a diameter of about 50 microns and containing about 1 to 2 glass balls per toner were obtained. When the same procedure as in Example 1 was conducted using the photoconductive toner particles thus prepared, good photoconductive characteristics were obtained in both of the cases of being charged positively and negatively.

EXAMPLE 5

100 Parts of polycarbonate particles of about 10 to 20 microns in diameter were added to 300 parts of a mixture having the same composition as in Example 1 followed by mixing well to provide a uniform dispersion. Then the dispersion was subjected to spray drying, whereby photoconductive toner particles of a diameter of about 40 to 60 microns and containing 1 to 3 polycarbonate particles per toner were obtained. When the same procedure as in Example 1 was conducted using the photoconductive toner particles, good photoconductive characteristics were obtained in both of the cases of being charged positively and negatively.

EXAMPLE 6

80 Parts of a solvent-soluble polyester resin (a condensation polymer of a mixture of terephthalic acid and isophthalic acid in 50:50 molar ratio as the acid component and a mixture of ethylene glycol and neopentyl glycol in a 45:55 molar ratio as the glycol component; viscosity of 0.59 ± 0.03 at 20°C), 20 parts of tetracyanoquinodimethane, and 20 parts of 2,4,7-trinitrofluorenone were dissolved in 250 parts of a toluene solution and after adding thereto 20 parts of zinc oxide having absorbed thereon 20/1,000 part of Food Blue No. 1, the mixture was mixed well to provide a uniform dispersion. By spray drying the dispersion, photoconductive toner particles having a diameter of about 30 to 60 microns were obtained. When the same procedure as in Example 1 was conducted using the photoconductive toner particles, good photoconductive characteristics were obtained in both of the cases of being charged positively and negatively.

While the invention has been described in detail and with reference to specific embodiments thereof, it will be apparent to one skilled in the art that various changes and modifications can be made therein without departing from the spirit and scope thereof.

What is claimed is:

1. Photoconductive toner particles, each particle consisting of a mixture of photoconductive pigment particles and a charge-transporting insulating binder within which is dispersed said photoconductive pigment particles, said insulating binder being capable of transporting charge carriers when the charge carriers are injected therein from said pigment and being selected from the group consisting of (a) resins sensitized by a Lewis acid, (b) resins having organic photoconductive material dissolved therein and (c) organic photoconductive polymers, the volume of said pigment in said toner being 2 to 30 volume percent of said toner and said charge-transporting binder being substantially transparent to light in the spectrally-sensitive region of said pigment.

2. The photoconductive toner particles as set forth in claim 1, in which said insulating binder has an absorption coefficient of less than $1.3 \times 10^2$ $mm^{-1}$.

3. The photoconductive toner particles as set forth in claim 1, in which said insulating binder contains more than 5 weight percent of a Lewis acid.

4. The photoconductive toner particles as set forth in claim 3, in which said Lewis acid is 2,4,7-trinitro-9-fluorenone, 2,4,5,7-tetranitro-9-fluorenone, picric acid, 1,3,5-trinitrobenzene, chloranil, 4,4-bis(dimethylamino)benzophenone, tetrachlorophthalic anhydride, benzanthracene-7,72-dione, tetracyanobenzoquinodimethane, tetracyanoethylene, or a mixture thereof.

5. Photoconductive toner particles, each particle comprising a mixture of a photoconductive pigment and an insulating binder within which is dispersed said photoconductive pigment particles, said insulating binder being capable of transporting charge carriers when the charge carriers are injected therein from said pigment, the volume of said pigment being 2 to 43 parts by volume per 100 parts by volume of said binder and said binder comprising a surface layer substantially transparent to light in the spectrally-sensitive region of said pigment and at least one core material substantially transparent to light in the spectrally-sensitive region of said pigment.

6. The photoconductive toner particles as set forth in claim 5, in which said insulating binder has an absorption coefficient of less than $1.3 \times 10^2$ $mm^{-1}$.

7. The photoconductive toner particles as set forth in claim 5, in which said insulating binder contains more than 5 weight percent of a Lewis acid.

8. The photoconductive toner particles as set forth in claim 7, in which said Lewis acid is 2,4,7-trinitro-9-fluorenone, 2,4,5,7-tetranitro-9-fluorenone, picric acid, 1,3,5-trinitrobenzene, chloranil, 4,4-bis(dimethylamino)benzophenone, tetrachlorophthalic anhydride, benzanthracene-7,12-dione, tetracyanobenzoquinodimethane, tetracyanoethylene or a mixture thereof.

9. The photoconductive toner particles as set forth in claim 5, in which said core material is a plastic, glass, ceramic, or a hydrocarbon vapor.

10. The photoconductive toner particles as set forth in claim 5, in which the volume of the mixture of said photoconductive pigment and said insulating binder in said toner is 0.01 to 75 volume percent of said toner.

11. In a process for recording images, comprising forming a layer of charged photoconductive toner particles on a conductive support, image exposing said layer to thereby dissipate the charge at the exposed area, removing those toner particles which have a reduced electrostatic attractive force for the support, recovering said removed particles and using in said process repeatedly, the improvement wherein said toner is a photoconductive toner each particle comprising a mixture of a photoconductive pigment particles and an insulating binder within which is dispersed said photoconductive pigment particles, said insulating binder being capable of transporting charge carriers when the charge carriers are injected therein from said pigment, the volume of said pigment in said toner being 2 to 30 volume percent of said toner and said binder being substantially transparent to light in the spectrally-sensitive region of said pigment.

12. Photoconductive toner particles as in claim 11 where said organic photoconductive polymers are sensitized by a sensitizer selected from the group consisting of a sensitizing dye and Lewis acid.

13. Photoconductive toner particles as in claim 1 where said photoconductive pigment particles are sensitized with a sensitizer.

14. Photoconductive toner particles as in claim 13 where said sensitizer is selected from the group consisting of xanthene dyes, phthalein dyes, triphenylmethane dyes, anthraquinone dyes, azo dyes, cyanine dyes, and merocyanine dyes.

* * * * *